US012752954B2

(12) United States Patent
Laidler et al.

(10) Patent No.: US 12,752,954 B2
(45) Date of Patent: Oct. 6, 2026

(54) PACKAGING MACHINE

(71) Applicant: MPAC Group PLC, Coventry (GB)

(72) Inventors: Martin Laidler, North Yorkshire (GB); Paul Hendrick, North Yorkshire (GB); Tom Pascsall, North Yorkshire (GB)

(73) Assignee: MPAC LAMBERT LIMITED, Tadcaster (GB)

( * ) Notice: Subject to any disclaimer, the term of this patent is extended or adjusted under 35 U.S.C. 154(b) by 383 days.

(21) Appl. No.: 18/556,531

(22) PCT Filed: Apr. 22, 2022

(86) PCT No.: PCT/GB2022/051031
§ 371 (c)(1),
(2) Date: Oct. 20, 2023

(87) PCT Pub. No.: WO2022/223991
PCT Pub. Date: Oct. 27, 2022

(65) Prior Publication Data

US 2024/0190604 A1 Jun. 13, 2024

(30) Foreign Application Priority Data

Apr. 23, 2021 (GB) ..... 2105799

(51) Int. Cl.
*B65B 69/00* (2006.01)
*B65B 65/00* (2006.01)
(Continued)

(52) U.S. Cl.
CPC ..... *B65B 69/0033* (2013.01); *B65B 65/003* (2013.01); *B65B 69/0008* (2013.01);
(Continued)

(58) Field of Classification Search
CPC ..... B65B 69/005; B65B 69/0008; B65B 69/0033; B65B 57/12; B65B 61/065
See application file for complete search history.

(56) References Cited

U.S. PATENT DOCUMENTS

2016/0045243 A1 2/2016 Vogt et al.
2018/0361047 A1 12/2018 Gillespie et al.
(Continued)

FOREIGN PATENT DOCUMENTS

CN 110116840 A 8/2019
CN 111532526 A 8/2020
(Continued)

OTHER PUBLICATIONS

Lawder, M.; International Search Report; Jul. 18, 2022; 6 pages; HV, Rijswijk.
(Continued)

*Primary Examiner* — Kaitlin S Joerger
(74) *Attorney, Agent, or Firm* — STETINA GARRED BRUCKER & NEWBOLES

(57) ABSTRACT

An apparatus for removing an object from within a bag comprising: a surface with an aperture for receiving the object; and cutting means for cutting the bag; wherein the surface and/or the object are arranged to be moved relative to one another; wherein the cutting means is arranged to cut the bag; and wherein the aperture is sized relative to an end of the object such that the surface separates the cut bag from the object as the object passes through the aperture.

18 Claims, 8 Drawing Sheets

(51) Int. Cl.

| | |
|---|---|
| *B65B 57/00* | (2006.01) |
| *B65B 57/12* | (2006.01) |
| *B65B 59/00* | (2006.01) |

(52) U.S. Cl.

CPC ..... *B65B 57/005* (2013.01); *B65B 57/12* (2013.01); *B65B 59/001* (2019.05)

(56) References Cited

U.S. PATENT DOCUMENTS

| | | | | |
|---|---|---|---|---|
| 2020/0172280 | A1* | 6/2020 | Franke | B65B 69/0008 |
| 2020/0339298 | A1* | 10/2020 | Edwards | B23K 26/0626 |
| 2021/0191366 | A1* | 6/2021 | Edwards | B26D 5/005 |
| 2021/0292032 | A1* | 9/2021 | Trebbi | B65B 69/0058 |
| 2021/0292033 | A1* | 9/2021 | Gabusi | B65B 69/0008 |
| 2024/0034506 | A1* | 2/2024 | Kühnle | B65B 69/0058 |

FOREIGN PATENT DOCUMENTS

| | | | | |
|---|---|---|---|---|
| CN | 112249456 | A | 1/2021 | |
| DE | 102011080289 | A1 * | 2/2013 | B65B 69/0008 |
| DE | 102017012236 | B4 * | 10/2023 | B65B 69/0008 |
| EP | 2025601 | A2 | 2/2009 | |
| EP | 2025601 | A3 | 3/2009 | |
| GB | 2419871 | A | 5/2006 | |
| SE | 442506 | | 1/1986 | |

OTHER PUBLICATIONS

Lovrecich, Patrizia; International Search Report and Written Opinion; Jul. 25, 2022; 6 pages; HV, Rijswijk.

Cornfield, Joe; Combined Search and Examination Report; Jul. 29, 2021; 7 pages; South Wales.

* cited by examiner

PACKAGING MACHINE

CROSS-REFERENCE TO RELATED APPLICATIONS

The present application claims priority to PCT International Patent Application No. PCT/GB2022/051031, filed Apr. 22, 2022, and Great Britain Patent Application No. 2105799.7, filed on Apr. 23, 2021, the disclosures of which are incorporated herein by reference.

STATEMENT RE: FEDERALLY SPONSORED RESEARCH/DEVELOPMENT

Not Applicable

BACKGROUND

This invention relates apparatus for removing an object from within a bag, in particular a vial from within a bag.

BACKGROUND OF THE INVENTION

Samples taken for analysis, testing, or investigation, such as swaps and chemicals etc, are typically transported using containers, such as vials, which carry the samples therein.

The vials themselves are typically held within one or more bags to facilitate transportation of the vials, for example over long distances. In some cases, sampling paraphernalia, such as used swap covers, absorbent patches etc, may also be contained within the one or more bags, along with the vials. Once the vials reach their destination for analysis, testing, or investigation, each vial must be removed/separated from their respective bags, and sampling paraphernalia if present, to allow the samples held therein to be accessed for analysis. Known processes for separating bags from vials held therein are time consuming and require a large amount of effort, especially if there are a large number of vials to process.

SUMMARY OF THE INVENTION

In a first aspect of the invention, there is provided an apparatus for removing an object from within a bag comprising: a surface with an aperture for receiving the object; and cutting means for cutting the bag, wherein the surface and/or the object are arranged to be moved relative to one another; wherein the cutting means is arranged to cut the bag; and wherein the aperture is sized relative to an end of the object such that the surface separates the cut bag from the object as the object passes through the aperture.

In this way, an object can be suitably removed from a bag. This allows a high throughput of objects within bags to be processed by the apparatus to remove the respective bags of each object. In particular, this arrangement is suitable for processing a large batch of vials within bags. The arrangement is less time consuming and requires less effort relative to conventional methods for processes for separating bags from objects.

Preferably, the apparatus further comprises: positioning means for positioning the object; displacing means for displacing the object; and a controller for controlling the cutting, the positioning, and the displacing means, wherein the positioning means is arranged to position the object in a first predetermined position relative to the aperture; and wherein the displacing means is arranged to move the object relative to the surface by displacing the object through the aperture. In this way, the operation of the positioning means, the cutting means and the displacing means can be suitably controlled and/or synchronised as desired.

Preferably, the displacing means is arranged to partially displace the object through the aperture before fully displacing the object through the aperture, and the cutting means is arranged to cut the bag when the object is partially displaced through the aperture. In this way, the object can be partially passed through the aperture, cut by the cutting means, and then fully displaced through the aperture such that the bag is removed from the object.

Preferably, before the positioning means is arranged to position the object in the first predetermined position, the positioning means is arranged to position the object in a second predetermined position relative to the cutting means such that the bag cut is before the object is moved into the first predetermined position. In this way, the object can be cut by the cutting means before the object is displaced through the aperture such that the bag is removed from the object.

Preferably, in the second predetermined position, the bag intersects a cutting region of the cutting means, and, in the first predetermined position, an end of the object proximate to an edge of the bag that has been cut faces the aperture. In this way, the cut edge of the bag contacts the edges of the aperture of the plate. This causes relatively high frictional forces at the points of contact between the edges of the bag and the edges and/or the area surrounding the aperture such that the bag begins to fold or crumple against the plate. The crumpling of the bag then further facilitates frictional engagement between the plate and the bag. The plate thus arrests or attenuates the movement of the bag through the aperture 60 as the object is displaced through the aperture.

Preferably, the displacing means comprises a moveable rod and is arranged to displace the object through the aperture via the moveable rod.

Preferably, the positioning means comprises a gripping means that is arranged to releasably grasp the object.

Preferably, the gripping means partially releases the object as it is displaced through the aperture. This facilitates displacement of the object through the aperture and the separation of the bag from the object.

Preferably, the apparatus further comprises an input conveyor that is arranged to receive and convey the object to the positioning means for positioning. This facilitates achieving a high processing throughput objects by the apparatus.

Preferably, the apparatus further comprises a position detection means that is arranged to determine positional data of the object as the object is conveyed to the positioning means, wherein the positioning means is arranged to facilitate positioning of the object using the positional data. This facilitates grasping of the object by the positioning means from the input conveyor.

Preferably, the apparatus further comprises a leak detection means that is arranged to determine whether fluid has leaked into the bag. In this way, bags containing leaked fluid, which is undesirable, can be detected and discarded.

Preferably, the positioning means is arranged to discard the object if the leak detection means determines that fluid has leaked into the bag.

Preferably, the position detection means and/or the leak detection means are implemented using a machine vision system.

Preferably, the positioning means is arranged to discard the separated bag. In this way, the separated bag does not interfere with subsequent processing of another object by the apparatus. For example, the separated bag is not able to block the aperture.

Preferably, the displacing mechanism comprises a guard that is arranged to discard the separated bag from the displacing mechanism if the positioning arm fails to discard the separated bag. In this way, the separated by does not interfere with subsequent processing of another object by the apparatus. For example, the separated bag is not able to block the aperture.

Preferably, the bag is arranged to be cut a predetermined distance from the end of the object.

Preferably, the bag is arranged to be cut the predetermined distance by arranging the cutting means to cut the bag the predetermined distance from the end of the object and/or by arranging the positioning means to position the end of the object the predetermined distance from the cutting means. In this way, a length of the bag between an end of the object and the edge of the cut bag can be controlled such that it is a suitably small length such that it does not resist/prevent the object from being displaced through the aperture.

Preferably, the predetermined distance is a multiple between 0 and 2 of a diameter or a width of the object. In this way, a length of the bag between an end of the object and the edge of the cut bag is an optimal such that it does not resist/prevent the object from being displaced through the aperture.

Preferably, the surface is a planar structure that is fixed relative to the positioning means. This may facilitate contact between the bag and the plate, as more surface area of the plate is proximate to the bag as it contacts the plate.

Preferably, the apparatus further comprises an output conveyor, wherein the object is arranged to be received by the output conveyor after it passes through the aperture. This facilitates achieving a high processing throughput objects by the apparatus.

Preferably, the object is generally cylindrical and the shape of the aperture is generally circular; and the object has a diameter of between 5 mm and 60 mm, and a ratio of a diameter of the aperture to the diameter of the object is between 1.17 and 4.85. In this way, the aperture is sized relative to the diameter of the end portion of the object such that, as the object is displaced through the aperture, sufficient frictional engagement between the plate and the bag occurs such that the plate separates the bag from the object as the object passes through the aperture.

Preferably, the object has a diameter of between 20 mm and 60 mm, and a ratio of a diameter of the aperture to the diameter of the object is between 1.17 and 3.5.

Preferably, the object has a diameter of around 20 mm, and the ratio of the diameter of the aperture to the diameter of the object is between 3 and 3.5.

Preferably, the object has a diameter of around 40 mm, and the ratio of the diameter of the aperture to the diameter of the object is between 1.25 and 1.75.

Preferably, the bag comprises a flexural modulus of between 0.2 and 3.5 GPa, and a dimensionless coefficient of friction of between 0.1 to 1.0. In this way, the bag is a flexible material with a sufficient coefficient of friction against the plate such that sufficient frictional engagement between the bag and plate can occur for arresting the bag from the object.

Preferably, an edge of the bag contacts the surface as the surface separates the bag from the object; and a width of the edge of the bag is between 50 mm and 535 mm.

Preferably, a width of the edge of the bag is between 160 mm and 250 mm.

In a second aspect of the invention there is provided a method of removing an object from within a bag comprising the steps of: positioning the object in a first predetermined position relative to an aperture in a surface; cutting the bag; and moving the surface and/or the object relative to one another, wherein the aperture is sized relative to an end of the object such that the surface separates the cut bag from the object as the object passes through the aperture.

Preferably, the object is moved relative to the surface by displacing the object through the aperture.

Preferably, before the object is in the first predetermined position, the object is positioned in a second predetermined position relative to the cutting means such that the bag cut is before the object is moved into the first predetermined position.

BRIEF DESCRIPTION OF THE DRAWINGS

These and other features and advantages of the various embodiments disclosed herein will be better understood with respect to the following description and drawings, in which like numbers refer to like parts throughout, and in which.

Embodiments of the invention will now be described by way of example, with reference to the drawings in which.

DETAILED DESCRIPTION

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

The present embodiments represent the best ways currently known to the applicant of putting the invention into practice, but they are not the only ways in which this can be achieved. They are illustrated, and they will now be described, by way of example only.

Figure 1:
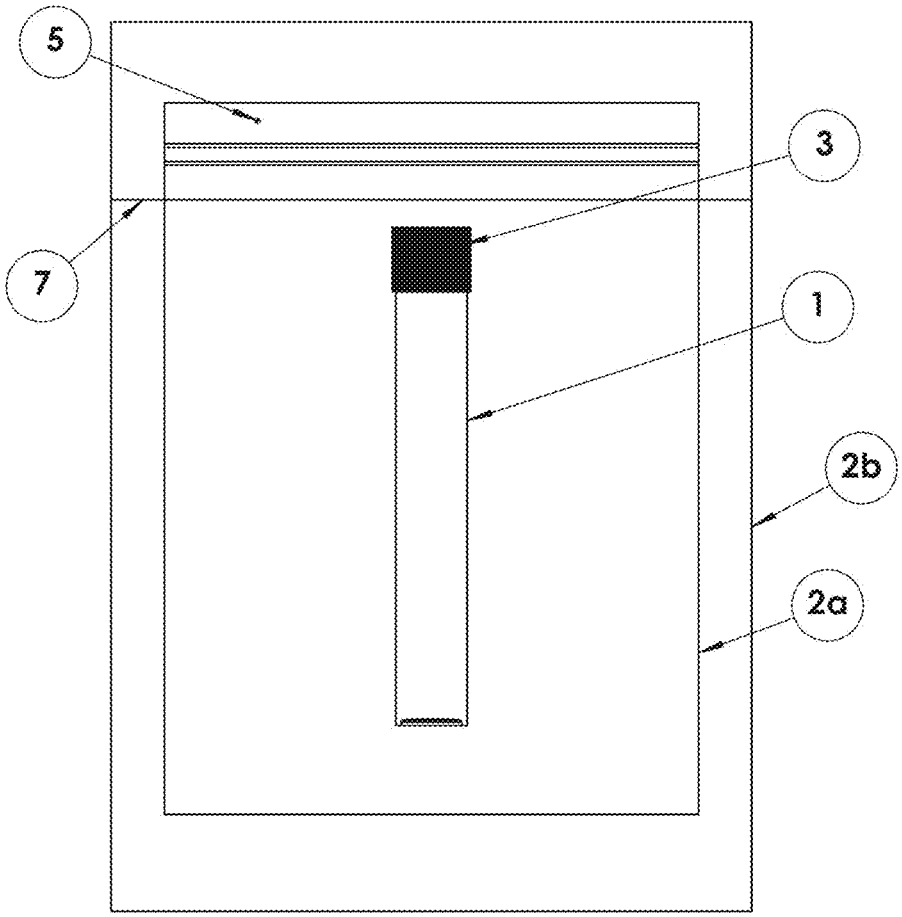
FIG. 1 illustrates a front view of the vial held within two bags.

With reference to FIG. 1, a vial 1 containing a sample therein is contained within a bag 2*a*. The vial 1 is a generally cylindrical object. The bag 2*a* is contained within a further bag 2*b*. The further bag 2*b* may contain sampling paraphernalia, such as used swap covers etc. The bags 2*a*, 2*b* facilitate transportation and protection of the vial 1, for example during the vial's transit to a site for analysis of the sample within the vial 1. In some cases, the vial 1 may be contained within less than or more than two bags. The bag(s) may be a film(s) that envelopes the vial 1 such that the vial is contained within the film. In this document, the term 'bag' means a flexible container.

Figure 2:
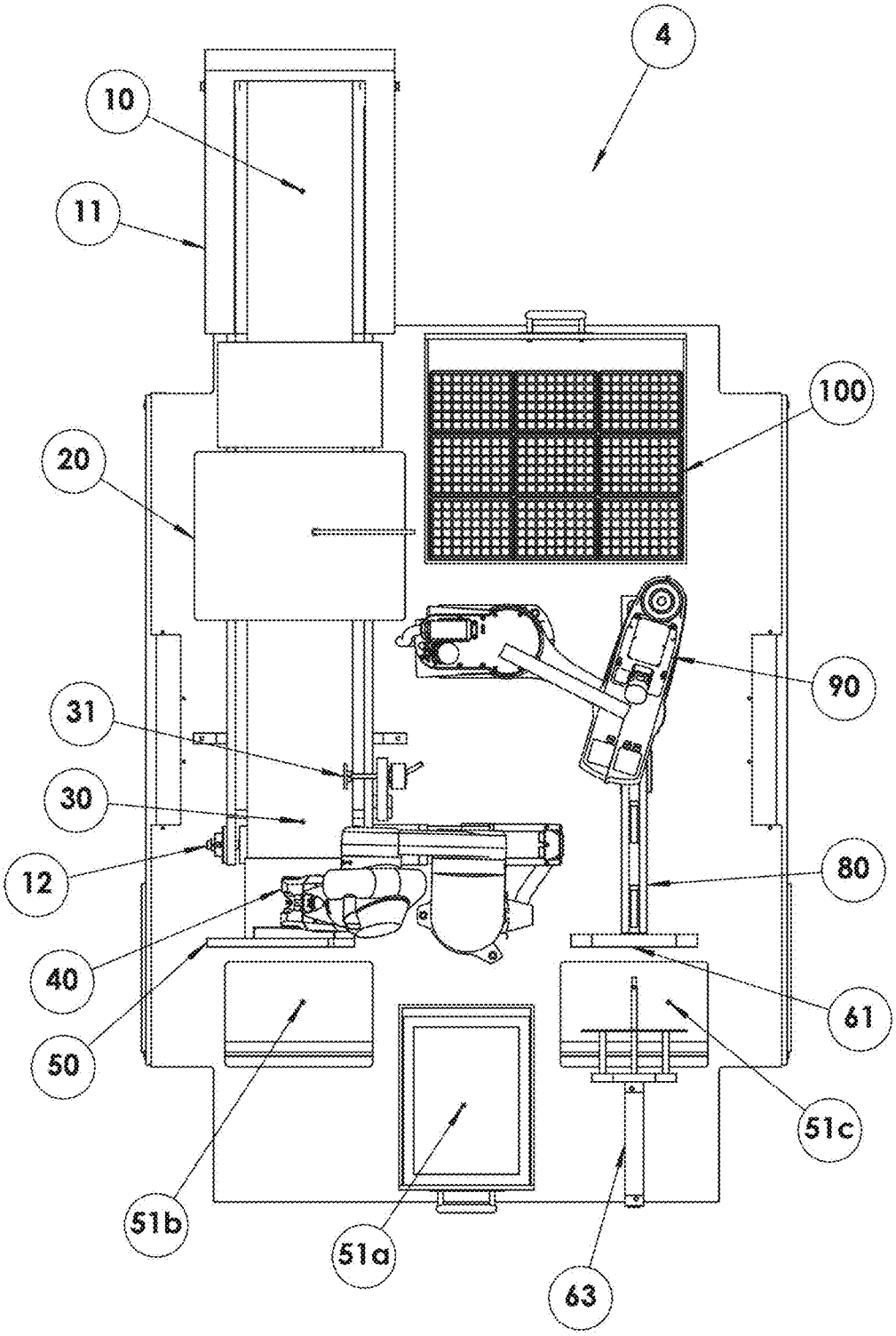
FIG. 2 illustrates a plan overview of the apparatus for removing a vial from within a bag.

FIG. 2 illustrates an overview of a bag removal apparatus 4. Upon receiving the vial 1, the apparatus 4 is configured to remove the vial 1 from within the bags 2*a*, 2*b*, as will now be described.

The apparatus 4 comprises an input conveyor 10 that is configured to receive the vial 1 at a first end 11 of the input conveyor 10, for example by a user placing the vial 1 upon the input conveyor 10, and convey the vial 1 to a second end 12 of the input conveyor 10. In this arrangement, the input conveyor 10 is a conveyor belt system. In other arrangements, the input conveyor 10 may be other suitable conveying means for conveying vials.

As the vial 1 is conveyed to the second end 12, it passes through a detection module 20. The detection module 20 is configured to determine the position of the vial 1 within the bags 2*a*, 2*b*. When providing several vials to the apparatus 4 for processing, the positions of the vials within their respective bags may differ. This is because each vial may undergo translational movement during the vials transit and general handling prior to being received by the apparatus 4. Determining the position of each vial allows subsequent manipulation of the vial 1 via a positioning arm 40, which will be described later on.

In this arrangement, positional data of the vial 1 is determined using a machine vision system that is configured to obtain images of the vial 1 from within the detection module 20, allowing the position of the vial 1 to be determined. The positional data may for example correspond to two-dimensional coordinates of the vial 1 that are determined from the images. The positional data may also include the rotation and/or angle of the vial relative to a known orientation.

In this arrangement, the bags 2*a*, 2*b* comprise a translucent material to facilitate the determination of the position of the vial 1 by the detection module 20.

The detection module 20 is also configured to determine whether any fluid, other than in the vial 1, is present in the bags 2*a*, 2*b*. Fluid in the bags 2*a*, 2*b* may indicate that fluid has leaked into the bags 2*a*, 2*b*, either from the sample within the vial into the bags 2*a*, 2*b* or from outside the bags 2*a*, 2*b* via a tear. Bags containing leaked fluid is undesirable because the leaked fluid may contaminate the apparatus 4, in particular downstream of the input conveyor 10. In this arrangement, fluid detection is also determined by a machine vision system which is configured to obtain images of the vial 1 from within the detection module 20, allowing the determination of whether any fluid, other than in the vial 1, is present in the bags 2*a*, 2*b*. In this arrangement, the positional data and the fluid leaking data may be determined from the same image(s) obtained by the machine vision system.

Machine vision systems are well known to the skilled person, and the skilled person would therefore understand which of these systems are suitable to use for determining the position of the vial and/or whether any leaking has occurred in the bags.

In some arrangements, the detection module 20 may only determine positional data or fluid leaking data. The detection module 20 may comprise separate sub modules, one module for determining positional data and another module for determining whether any fluid leaking has occurred. In other arrangements, there may be no detection module 20. In this case, the position of the vial 1 within the bags 2*a*, 2*b* is suitably adjusted by a user or suitably automated arrangement prior to providing the vial to the input conveyor 10 to allow subsequent manipulation of the vial 1 by the positioning arm 40.

The positioning arm 40 is configured to grasp the vial 1 as the vial 1 approaches a pickup region 30 at the second end 12 of the input conveyor 10. In this arrangement, the positioning arm 40 is a programmable mechanical robotic arm that is configured to manipulate the vial 1. In other arrangements, the positioning arm 40 may be another suitable means, other than a robotic arm, for manipulating the vial 1, such as a gantry robot or an arrangement of actuators, each of which are arranged to manipulate the vial in a different plane of motion.

Once the vial 1 reaches the pickup region 30, the input conveyor 10 momentarily stops conveying to allow the positioning arm 40 to grasp the vial 1. In other arrangements, the input conveyor 10 may not stop conveying and the positioning arm 40 may grasp the vial 1 as it reaches the pickup region 30.

In order for the positioning arm 40 to determine when the vial 1 reaches the pickup region 30, the input conveyor 10 comprises an encoder 31. The encoder 31 is configured to provide the positioning arm 40 with positional data of the vial 1 corresponding to the location of the vial 1 on the input conveyor 10 relative to the pickup region 30. The positional data from the encoder 31, along with the positional data from the detection module 20, facilitate grasping of the vial 1 by the positioning arm 40 from the input conveyor 10.

Less preferably, in some arrangements, there may be no input conveyor 10. The input conveyor 10 may be replaced by another means for providing vials to the apparatus 4, in particular to the positioning arm 40, and the function of the detection module 20 may be carried out separately for each vial. For example, the input conveyor 10 may be replaced with a container that contains several vials within respective bags. In this case, the positioning arm 40 is configured to grasp each vial from the container for processing by the apparatus 4. Even less preferably, each vial within a bag may be provided to the positioning arm 40 by a user for processing by the apparatus 4.

Using the positional data from the detection module 20, the positioning arm 40 is able to locate and grasp the vial 1 via a gripping mechanism 41 (shown in FIG. 3*b*), which is actuated to releasably grip the vial 1. In this arrangement, the gripping mechanism 41 is configured to mechanically grasp the vial 1. In other arrangements, the gripping mechanism may be arranged to grasp the vial 1 using suction.

If the detection module 20 has determined that leaking has occurred in the bags 2*a*, 2*b*, the positioning arm 40 discards the vial 1. In this arrangement, the positioning arm 40 is configured to discard the vial 1 by positioning the vial 1 above a waste container 51*a*. The gripping mechanism 41 then releases the vial 1, along with the bags 2*a*, 2*b*, into the waste container 51*a* for subsequent disposal of the vial 1, for example by a user. The positioning arm 40 then returns to its initial position such that it is ready to grasp a subsequent vial from the input conveyor 10.

Figure 3A:
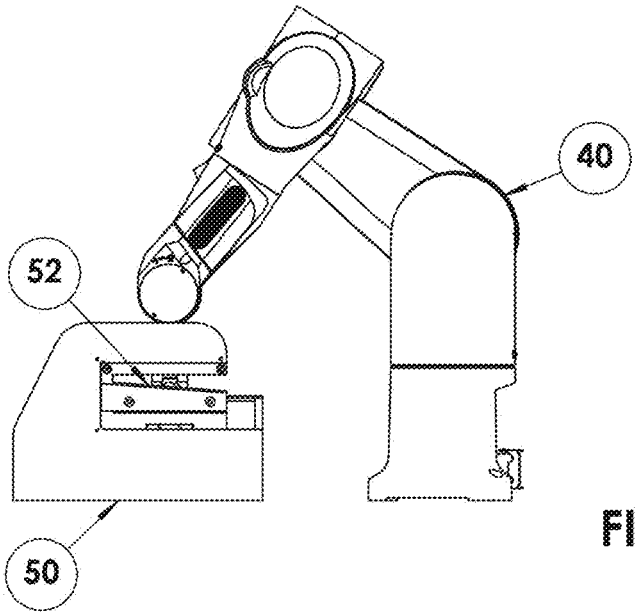
FIG. 3*a* illustrates a side view.
Figure 3B:
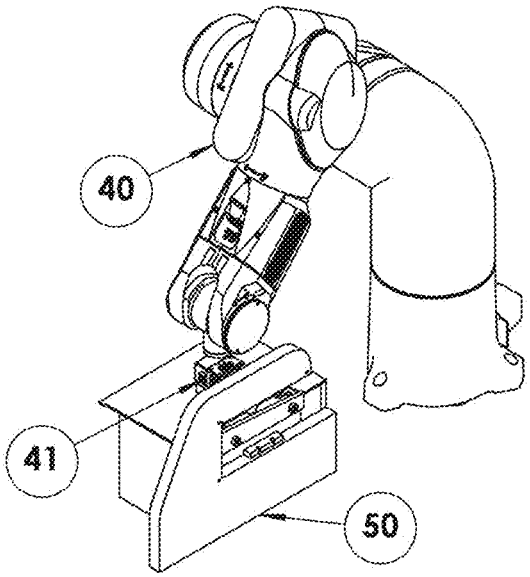
FIG. 3*b* illustrates a perspective view, of the positioning arm for the vial and the cutting mechanism for cutting the bags.

As illustrated in FIGS. 3*a* and 3*b*, if the detection module 20 determines that no leak has occurred in the bags 2*a*, 2*b*, the positioning arm 40 moves the vial 1 towards a cutting mechanism 50. The vial 1 is positioned in a first predetermined position relative to the cutting mechanism 50 such that an end portion 3 of the vial 1 is proximate to, but does not intersect, a cutting region of the cutting mechanism 50. Preferably, the end portion 3 is positioned perpendicular to the cutting region of the cutting mechanism 50. In this way, a top portion 5 of the bags 2*a*, 2*b* is positioned such it intersects the cutting region of the cutting mechanism 50 along a cutting line 7.

Once the end portion 3 of the vial 1 is suitably positioned proximate to the cutting mechanism 50, the cutting mechanism 50 is actuated cutting the bags 2*a*, 2*b* along the cutting line 7. The severed top portion 5 of the bags 2*a*, 2*b* is discarded from the cutting mechanism 50. Cutting the bags 2*a*. 2*b* in this way 'exposes' the vial 1 from within the bags 2*a*, 2*b*. In other words, the bags 2*a*, 2*b* are opened, via cutting, proximate to the end portion 3 of the vial 1 to expose the vial 1, in particular to expose the end portion 3 of the vial 1.

In this document, the term 'expose the vial' means that a pathway for the vial 1 is provided such that the vial can subsequently be ejected from within the bags 2*a*, 2*b* without being stopped/obstructed by the bags 2*a*, 2*b*.

In this arrangement, the severed top portion 5 of the bags 2*a*, 2*b* falls into a waste container 51*b* that is located proximate to the cutting mechanism 50. In other arrangements, there may be other means to discard the severed top portions of the bags.

In this arrangement, the cutting mechanism 50 comprises a cutting blade 52 that is actuated to cut the bags 2*a*, 2*b* along the cutting line 7 to expose the vial 1. In this arrangement, the cutting blade 52 is a guillotine blade that is actuated such that the blade moves towards and penetrates the bags 2*a*, 2*b*, which cuts the bags 2*a*, 2*b*. In other arrangements, the cutting blade 52 may be a rotary cutting blade that can be operated to cut the bags 2*a*, 2*b*. In this case, the cutting mechanism 50 and/or cutting blade 52 may be moveable relative to the bags 2*a*, 2*b* such that the cutting blade 52 can receive the bags 2*a*, 2*b* before contacting the bags 2*a*, 2*b*. For example, the cutting mechanism 50 may be a robotic arm comprising a rotary cutting blade. Alternatively, the cutting mechanism 50 may comprise other suitable means for allowing the bags 2*a*, 2*b* to be cut to expose the vial 1, such as a cutting laser.

Figure 4A:
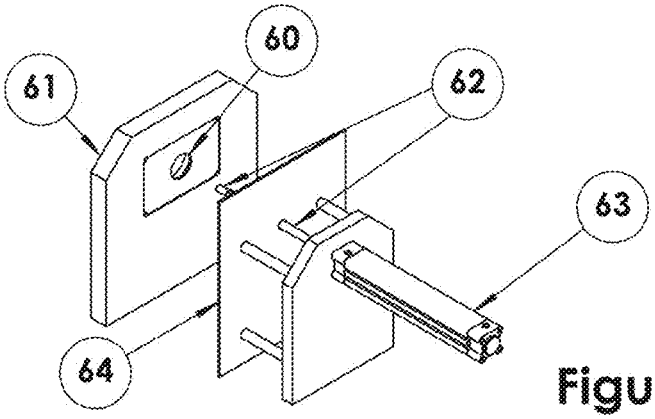
FIG. 4*a* illustrates a perspective view of the plate with an aperture and a displacing mechanism.

Once the bags 2*a*, 2*b* have been cut, the positioning arm 40 moves the vial 1 towards a plate 61 for the removal of the bags 2*a*, 2*b* from the vial 1. As illustrated in FIG. 4*a*, the plate 61 is fixed relative to the positioning arm 40 (not shown in FIG. 4*a*), and thus the vial 1, and comprises an aperture 60 for receiving the vial 1. As will be described later on, the aperture 60 is larger than a diameter of the end portion 3 of the vial 1.

Figure 4B:
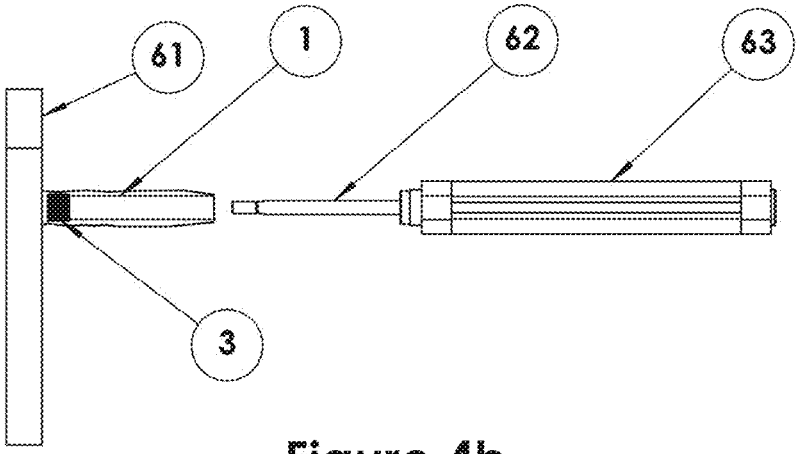
FIG. 4*b* illustrates a side view of the vial being positioned between the plate and the displacing mechanism.

As illustrated in FIG. 4*b*, a displacing mechanism 63 is configured proximate to the plate 61. The displacing mechanism 63 comprises a moveable rod 62 that is generally concentric with the aperture 60. The displacing mechanism is configured to actuate the rod 62 such that the rod reversibly moves towards the aperture 60. A space between the plate 61 the displacing mechanism 63 is suitable for receiving the vial 1 therein.

As the positioning arm 40 moves the vial 1 towards the plate 61, the vial 1 is positioned in the space between the plate 61 and the displacing mechanism 63. In particular, the end portion 3 of the vial 1 is positioned in a second predetermined position relative to the aperture 60 such that the end portion 3 is generally concentric with the aperture. In this position, the end portion 3 of the vial 1 is also generally concentric with the rod 62 of the displacing mechanism 63. Less preferably, in other arrangements, the positioning of the vial 1 relative to aperture may not be generally concentric. The positioning of the vial 1 relative to the aperture 60 may be facilitated by input data, such as a width of the vial, provided to a control system of the positioning arm 40 and/or by positional data from the detection module 20.

Figure 4C:
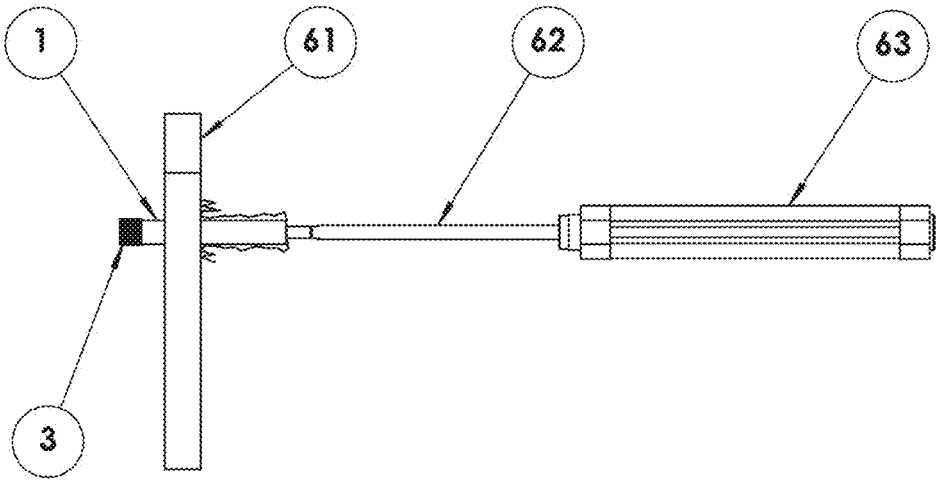
FIG. 4*c* illustrates a side view of the vial being displaced through the plate.

In one arrangement, as illustrated by FIG. 4*c*, once the vial 1 is positioned in the space between the plate 61 and the displacing mechanism 63 (i.e., the position illustrated by FIG. 4*b*) the gripping mechanism 41 partially releases the vial 1 such that the vial 1 remains grasped by the gripping mechanism 41 but may be displaced upon contact with a sufficient displacing force (i.e., from the displacing mechanism 63).

With the vial 1 partially grasped by the gripping mechanism 41, the displacing mechanism 63 actuates the rod 62, causing the rod 62 to contact and displace the vial 1 through the aperture 60. As the vial 1 begins to be displaced through the aperture 60, the bags 2*a*, 2*b* contact the plate 61 such that the bags 2*a*, 2*b* are prevented from completely passing through the aperture 60 as the vial is displaced through the aperture 60.

In this arrangement, the plate 61 has a planar structure and is made of metal. In this way, the plate 61 provides a structurally robust surface that is suitable for receiving and arresting the movement of the bags 2*a*, 2*b* upon contact between the plate 61 and the bags 2*a*, 2*b*. In other arrangements, the plate 61 may be another suitably shaped structure, such as an arcuate structure, for providing a surface that is suitable for contacting the bags 2*a*, 2*b*. The suitably shaped structure may be made of another material, other than metal, that is structurally robust, such as rigid plastic or glass. The suitably shaped structure may form part of other apparatus for receiving the vials ejected therefrom.

More specifically, as the vial 1 is displaced through the aperture 60, the edges of the bags 2*a*, 2*b* created by the cutting mechanism 50 along the cutting line 7 (i.e., the edges of the bags 2*a*, 2*b* proximate to the end portion 3 of the exposed vial 1 that provide a pathway into the bags 2*a*, 2*b*) contact the edges of the aperture 60. This causes relatively high frictional forces at the points of contact between the edges of the bags 2*a*, 2*b* and the edges and/or the area surrounding the aperture 60 such that the bags 2*a*, 2*b* begin to fold or crumple against the plate 61. The crumpling of the bags 2*a*, 2*b* then further facilitates frictional engagement between the plate 61 and the bags 2*a*, 2*b*. The plate 61 thus arrests or attenuates the movement of the bags 2*a*, 2*b* through the aperture 60 as the vial 1 is displaced through the aperture 60.

As will be described below, the aperture of the plate is sized relative to the vial to ensure sufficient frictional engagement between the bags and the plate occurs upon contact between the two. The plate can sufficiently arrest the bags from the vial as the vial passes through the aperture. In some cases, the bags may partially enter the aperture as they initially contact the plate, but the frictional engagement between the plate and the bags will be sufficient to ensure the bags do not completely pass through the aperture. In this way, the plate 61 is arranged to remove the bags 2*a*, 2*b* from the vial 1 as the vial 1 passes/is ejected through the aperture 60.

An output conveyor 80 collects the vial 1 as the vial 1 exits the aperture 60 (i.e., by completely passing through the aperture 60). The vial 1 falls directly onto the output conveyor 80, and a distance between the output conveyor 80 and the plate 61 is such that the vial 1 is not physically damaged as it falls onto the output conveyor 80. In other arrangements, the vials may be collected using another suitable means as the vials exit the aperture 60 such that the vials are not damaged.

As the rod 62 is returned to its initial position, the gripping mechanism 41 fully releases its grasp on the empty bags 2*a*, 2*b* such that the empty bags 2*a*, 2*b* fall into a waste container 51*c*, such as a waste chute. The positioning arm 40 returns to its initial position proximate to the input conveyor 10 such that it the arm 40 is ready to grasp a subsequent vial from the input conveyor 10.

The displacing mechanism 63 comprises a waste guard 64. The waste guard 64 ensures that, in the event the empty bags 2*a*, 2*b* catch onto the rod 62 and do not fall by their own accord, the empty bags 2*a*, 2*b* are stripped from the rod 62 and fall into the waste container 51*c* as the rod 62 retracts to behind the waste guard 64 (i.e., retracts to between the waste guard 64 and the displacing mechanism 63). This is because the waste guard 64 is sized such that, as the rod 62 passes therethrough, the waste guard 64 prevents the empty bags 2*a*, 2*b* from also passing therethrough. In other words, the waste guard 64 is sized such that the rod 62 may pass through it but any bags attached thereto cannot. The rod 62 is then primed for subsequent use, the space between the plate 61 and the displacing mechanism is ready to receive a subsequent vial contained with a bag.

The aperture 60 is sized relative to the diameter of the end portion 3 of the vial 1 such that, as the vial 1 is displaced through the aperture, sufficient frictional engagement between the plate 61 and the bags 2*a*, 2*b* occurs such that the plate 61 separates the bags 2*a*, 2*b* from the vial 1 as the vial passes through the aperture 60. The effectiveness of the plate 61 in arresting the bags 2*a*, 2*b* from the vial 1 as it passes through the aperture 60 (i.e. the amount of friction that occurs between the bags and the edges of the aperture) is primarily determined by the difference in size between the aperture 60 and the diameter of the end portion 3 of the vial 1. The size of the aperture 60 should be large enough to allow the end portion of the vial 1 to pass therethrough, but sufficiently small such that a large enough portion of the bags 2*a*, 2*b* contact the plate 61 to provide a sufficient degree of frictional engagement between the bags 2*a*, 2*b* and the plate 61 to arrest the bags 2*a*, 2*a* from the vial 1. In other words, the aperture 60 should be small enough to catch a sufficiently large portion of the edges of the open bags 2*a*, 2*b* but large enough to allow the vial 1 to pass through it. In this way, only the vial 1 can pass through the plate 61.

Therefore, the size of the aperture 60 of the plate 61 will depend on the size of the diameter of the end portion of vials that are intended to be processed by the apparatus 4 for bag removal. The size of the aperture 60 of the plate 61 can thus be optimised during the manufacture of the plate 61 according to size of the vials that are to be used with the apparatus 4.

In this arrangement, the aperture 60 is generally circular in shape. In one example, the aperture 60 has a diameter of 60 mm and the vial 1 has a diameter of 40 mm. The ratio of aperture diameter size to vial diameter size (i.e. aperture diameter size divided by vial diameter size) is therefore 1.5. In another example, the aperture 60 has a diameter of 65 mm and the vial 1 has a diameter of 20 mm. The ratio of the aperture diameter size to the vial diameter size is therefore 3.25. For vials having a diameter of 20 mm, the optimum ratio of aperture diameter size to vial diameter size is between 3 and 3.5. For larger vials, such as vials having a diameter of 40 mm, the optimum ratio of aperture diameter size to vial diameter size is between 1.25 and 1.75.

Preferably, the object has a diameter of between 5 mm and 60 mm, and the diameter of the aperture is larger than the diameter of the object: from slightly larger to five times larger than the diameter of the object.

In some arrangements, the aperture 60 may not be generally circular. As described later on, the apparatus 4 is not limited to processing only cylindrical objects, such as vials. In other arrangements, the vial may instead be another type of object contained within a bag. The shape of the aperture 60 will thus depend on the shape of the object that is intended to be passed through the aperture 60. As mentioned above, the aperture is sized relative to the object, which in this arrangement is a generally cylindrical vial, to ensure sufficient frictional engagement between the bag and the plate occurs upon contact between the two. For example, the object may be cuboidal. In this case, the aperture would be generally cubical in shape. In some less preferable arrangements, the aperture 60 may extend fully or partially towards an edge of the plate 61. In this case, the aperture is first sized relative to the object, and then the aperture is extended fully or partially towards an edge of the plate 61.

In addition to the ratio of the aperture diameter size to the vial diameter size, the effectiveness of the plate 61 in arresting the bags 2*a*, 2*b* from the vial 1 is also affected, to a lesser extent, by the material properties of the bags 2*a*, 2*b*. The bag should comprise a flexible material with a sufficient coefficient of friction against the material of the plate such that the sufficient frictional engagement between the bag and plate can occur for arresting the bag from the vial. More specifically, the bag comprises a material with a suitable flexural modulus such that crumpling of the bag is facilitated upon contact between the bag and the plate. The term 'flexural modulus' is well known to the skilled person and is understood to be the tendency for a material to resist bending. In this arrangement, the bags 2*a*, 2*b* are Polyethylene Terephthalate (PET) thermoplastic films having a flexural modulus of 1 gigapascals (GPa) or between 2.4 and 3.1 GPa, and a dimensionless coefficient of friction on metal of between 0.2 to 0.4. In another example, the bags 2*a*, 2*b* are Low Density Polyethylene thermoplastic films having a flexural modulus of 0.21 GPA or between 0.25 and 0.35 GPa, and a dimensionless coefficient of friction on metal of 0.1, 0.3 or 0.2 to 0.6. In another example, the bags 2*a*, 2*b* are Nylon thermoplastic films having a flexural modulus of 2.3 GPa or between 1.0 and 2.8 GPa, and a dimensionless coefficient of friction on metal of 0.2 to 0.9 or 0.19 to 0.95. Preferably, the bags have a flexural modulus of between 0.2 to 3.5 GPa, and a dimensionless coefficient of friction of between 0.1 to 1.0.

The effectiveness of the plate 61 in arresting the bags 2*a*, 2*b* from the vial 1 is also affected by a width of the bags 2*a*, 2*b* that is able to contact the plate 61 relative to a width of the bags between the contact points of the bag 2*a*, 2*b*. Preferably, the width of the edges of the bags 2*a*, 2*b* created via the cutting mechanism 50 along the cutting line 7 is sufficient, relative to the size of the aperture 60, to result in at least two contact points between the bags 2*a*, 2*b* and the plate 61 as the vial 1 is displaced through the aperture 60. More preferably, the bags 2*a*, 2*b* contact at least three quarters of a circumference of the aperture. In order to facilitate the effectiveness of the plate 61 in arresting the bags 2*a*, 2*b* from the vial 1, the width of the edges of the bags 2*a*, 2*b* beyond, or outside of, the contact points (herein referred to as the 'effective width' of the bags 2*a*, 2*b*) should be sufficiently large relative to a width of the bags 2*a*, 2*b* between the contact points such that frictional engagement between the contact points of the bags 2*a*, 2*b* is sufficient to arrest the bags 2*a*, 2*b* from the vial 1. If the effective width of the bag is too small, the friction between the bag and the plate at the points of contact between the bag and plate will not be sufficient to catch and arrest the bag from the vial. In other words, a sufficiently large effective width of the bags 2*a*, 2*b* will facilitate the effectiveness of the plate 61 in arresting the bags 2*a*, 2*b* from the vial 1.

The size of the aperture 60 can thus be optimised during manufacture, not only relative to the size of the diameter of the end portion 3 of the vial 1, as discussed above, but also relative to an effective width of the bags 2*a*, 2*b*. In this way, the apparatus 4 can be optimised for each batch of vials being processed, allowing the apparatus 4 to accommodate a large variety of vial and bag sizes. In other words, at the end of processing a batch of vials with a particular diameter and/or bag size, the plate of the apparatus 4 can be switched with another plate that is suitably sized to accommodate a batch of vials with a different size diameter and/or bag size.

The effectiveness of the plate 61 in arresting the bags 2*a*, 2*b* from the vial 1 is also affected by a distance between the end portion 3 of the vial 1 and the edge of the bags 2*a*, 2*b* created by the cutting mechanism 50 along the cutting line 7. If the distance between the end portion 3 of the vial 1 and the cutting line 7 is too large, the bags 2*a*, 2*b* may block the vial 1 from passing through the aperture 60, preventing the vial 1 from being displaced through the aperture 60. Thus, the distance between the end portion 3 of the vial 1 and the cutting line 7 should be sufficiently small such that the cut bags 2*a*, 2*b* do not prevent the vial 1 from being displaced through the aperture 60—this distance will depend on the size of the vial. The distance between the end portion 3 of the vial 1 and the cutting line 7 is configured via the cutting mechanism 50. Preferably, this distance is multiple between 0 and 2 of the diameter of the vial, or in the case of a non-cylindrical object a transverse width of the object.

Figure 5A:
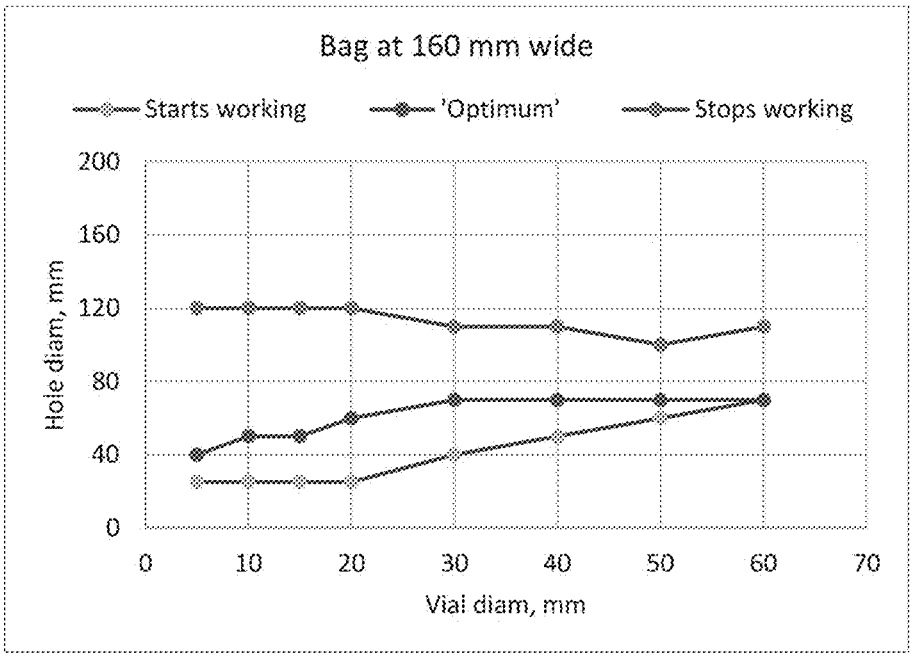
FIGS. 5*a* and 5*b* illustrate a first set of data testing the effectiveness of the plate in removing a bag having a width of 160 mm from a vial as it is displaced through an aperture in the plate.
Figure 5B:
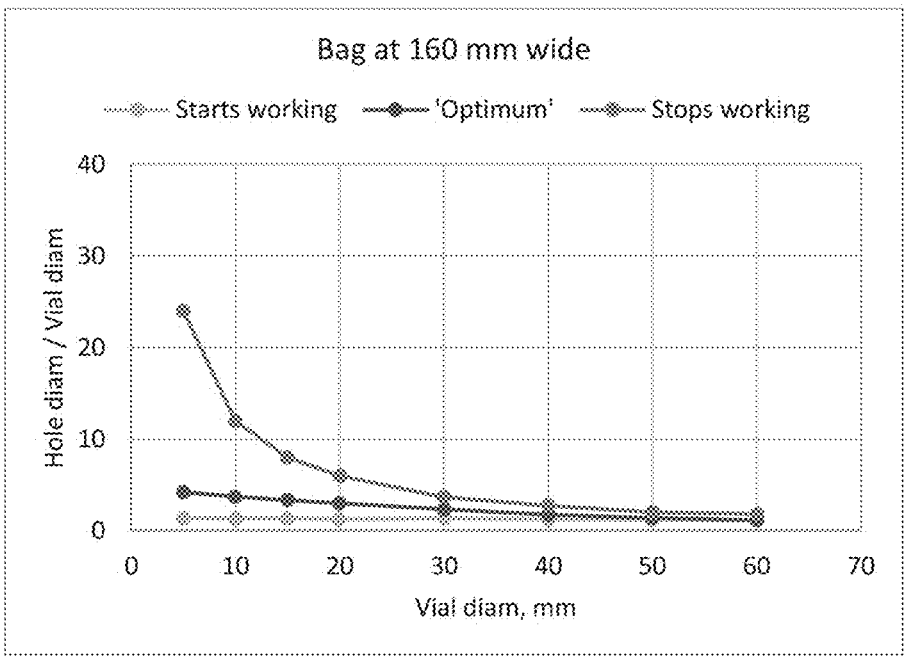

FIGS. 5*a* and 5*b* illustrate a first set of data testing the effectiveness of the plate in removing a bag having a width of 160 mm (which corresponds to the width of the edge of the bag at the cutting line 7 in FIG. 1) from a vial as it is displaced through an aperture in the plate. FIG. 5*a* illustrates hole diameter (the term 'hole' corresponds to aperture) vs vial diameter, and FIG. 5*b* illustrates the ratio of hole diameter to vial diameter vs vial diameter. It can be seen from FIG. 5*b* that, for bags having a width of 160 mm, the optimum ratio of aperture diameter size to vial diameter size is between 3 to 1.25 for vials having a diameter between 20 mm to 60 mm.

Figure 6A:
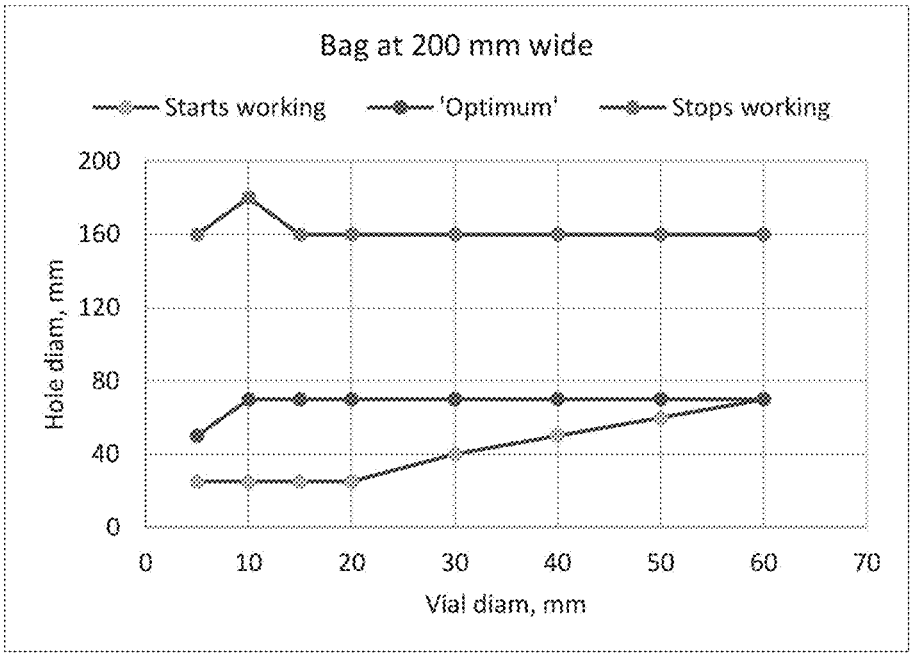
FIGS. 6*a* and 6*b* illustrate a second set of data testing the effectiveness of the plate in removing a bag having a width of 200 mm from a vial as it is displaced through an aperture in the plate.
Figure 6B:
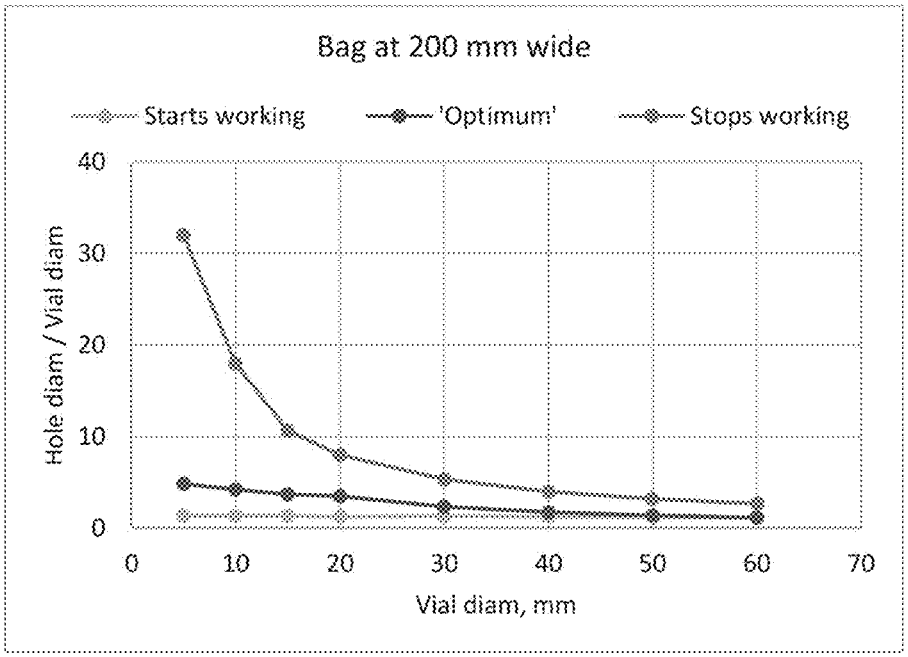

FIGS. 6*a* and 6*b* illustrate a second set of data with a bag having a width of 200 mm. It can be seen from FIG. 6*b* that, for bags having a width of 200 mm, the optimum ratio of aperture diameter size to vial diameter size is between 3.5 to 1.17 for vials having a diameter between 20 mm to 60 mm.

Figure 7A:
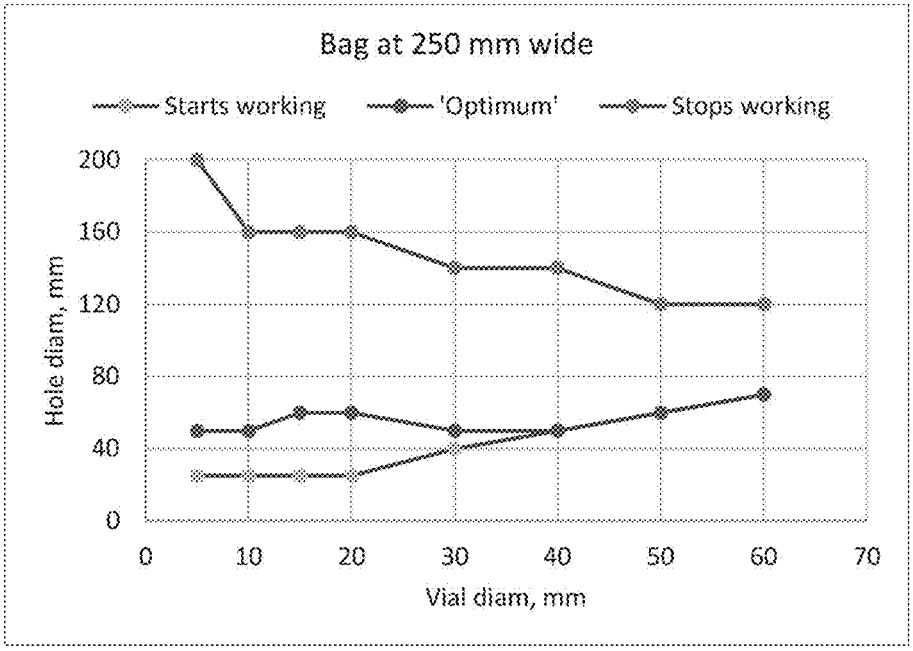
FIGS. 7*a* and 7*b* illustrate a third set of data testing the effectiveness of the plate in removing a bag having a width of 250 mm from a vial as it is displaced through an aperture in the plate.
Figure 7B:
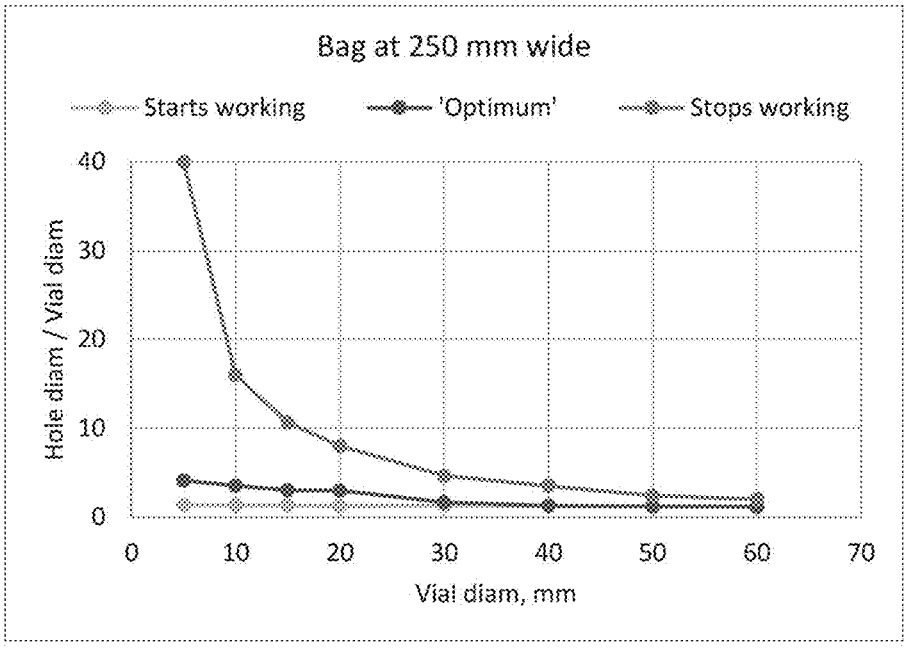

FIGS. 7*a* and 7*b* illustrate a third set of data with a bag having a width of 250 mm. It can be seen from FIG. 7*b* that, for bags having a width of 250 mm, the optimum ratio of aperture diameter size to vial diameter size is between 3 to 1.17 for vials having a diameter between 20 mm to 60 mm.

For bags having a width of between 160 mm and 250 mm the optimum ratio of aperture diameter size to vial diameter size is between 1.17 and 4.85 for vials having a diameter between 5 mm to 60 mm, and between 3.54 and 4.23 for vials having a diameter between 15 mm to 70 mm.

For bags having a width of between 160 mm and 250 mm, the optimum ratio of aperture diameter size to vial diameter size is between 3.54 and 4.23 for vials having a diameter of 10 mm.

The bags may have a width of between 50 mm and 535 mm, but more preferably have a width between 160 mm and 250 mm.

In this arrangement, the output conveyor 80 is an arrangement of vibratory rails that are configured to receive the vial 1 from the plate 61 and convey the vial 1 using vibratory motion of the rails. As the vial 1 transitions along the rails, it is reorientated from horizontal orientation (i.e., parallel with respect to a longitudinal axis of the output conveyor 80) to a vertical orientation (i.e., perpendicular with respect to a longitudinal axis of the output conveyor 80). This is achieved due to the spacing between the rails, which allows the body of the vial 1 to pass therethrough, but not the end portion 3, or 'cap', of the vial 1—the rails retain the end portion 3 of the vial 1. Reorientation and/or conveying of the vial 1 along the output conveyor 80 may be pneumatically or mechanically assisted.

Finally, the vial 1 is conveyed to an extraction region at an end of the output conveyor 80 for extraction. In this arrangement, the vial 1 is extracted using a second positioning arm 90, which is configured to detect the arrival of the vial 1 at the extraction region. Once detected, the positioning arm grasps and moves the vial 1 from the output conveyor 80 to a known vacant space in an output tray 100. In this way, vials are removed from the apparatus. Once the output tray 100 is full of vials (i.e., the tray 100 has no more vacant spaces for receiving vials), the tray 100 can be replaced, for example by a user. In other arrangements, the tray 100 may be replaced after a predetermined time period and/or after the tray 100 has received a predetermined number of vials.

Less preferably, in other arrangements, there may be no output conveyor 80. For example, vials may fall from the plate 61 directly into a container. In this case, the container can be replaced by a user once its capacity to hold vials has been reached.

In this arrangement, the conveyors 10, 80, the positioning arms 40, 90, the cutting mechanism 50, and the displacing mechanism 63 are all controlled by a controller (not shown) that is in electronic communication with each of these elements. In this way, the operation of each of the elements of the apparatus 4 can be suitably controlled and/or synchronised as desired. Less preferably, in some arrangements, the control of one or more of these elements may instead be controlled by a user.

As mentioned above, although the apparatus 4 has been described above as being used for removing a vial from with a bag, the apparatus 4 is not limited to only processing vials. In other arrangements, the vial may instead be another type of object contained within a bag. In these cases, the aperture of the plate is sized relative to a maximum diameter, or maximum width and height, of the object such that, as the object is displaced through the aperture, sufficient frictional engagement between the plate and the cut bag occurs upon contact between the bag and the plate to separate the bag from the object as the object passes through the aperture. Preferably, the objects have a generally uniform diameter, or width and height, along a longitudinal length of the object. For example, the object may be a cylindrical object other than a vial. In another example, as discussed above, the object may cuboidal.

Figure 4D:
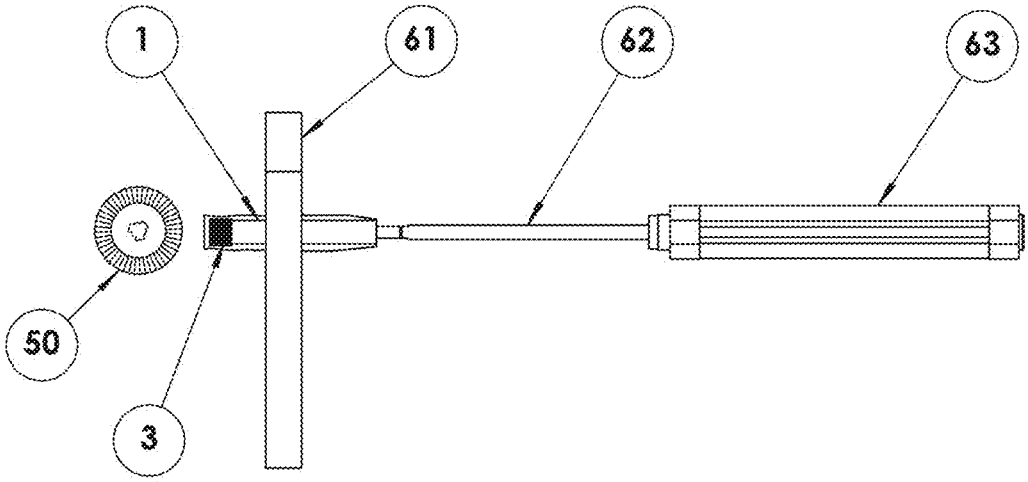
FIG. 4*d* illustrates an embodiment whereby the vial is first partially displaced through the plate before being cut by the cutting mechanism.

In other arrangements, as illustrated by FIG. 4*d*, the bag may instead be cut by the cutting mechanism 50 after the object is partially displaced through the aperture 60. In this case, once the object is positioned relative to the aperture 60, the displacing mechanism 63 partially displaces the object through the aperture 60. The cutting mechanism 50 is then arranged to cut the bag when the object is partially displaced through the aperture 60. The object is then fully displaced through the aperture 60 such that the plate 61 separates the cut bag from the object as the object fully passes through the aperture 60. In this case, the cutting mechanism 50 is moveable and comprises a rotary cutting blade 52 as described earlier. Once the object is partially displaced through the aperture 60, the cutting mechanism 50 is positioned relative to an end of the object passing through the aperture 60 such that the cutting mechanism 50 can be actuated to cut the bag.

In another embodiment, there may be no displacing mechanism 63. In this case, the plate 61 is moveable, and the object is grasped by the gripping mechanism 41 at an end of the object opposite to the end that is positioned relative to the aperture 60. Once the object is positioned relative to the aperture 60, the plate 61 is moved relative to the object such that as the object passes through the aperture 60, sufficient frictional engagement between the plate 61 and the cut bag occurs upon contact between the bag and the plate 61 to separate the bag from the object as the object passes through the aperture 60. Further, the bag may instead be cut by the cutting mechanism 50 after the plate 61 is partially passed over the object. In this case, the cutting mechanism 50 is moveable as described above, and once the plate 61 is partially passed over the object such the object partially passes through the aperture 60, the cutting mechanism 50 is arranged to cut the bag. The plate 61 then continues to move relative to the object such that the object fully passes through the aperture 60 such that the plate 61 separates the cut bag from the object as the object fully passes through the aperture 60.

In some arrangements, both the object and the plate are arranged to be moved relative to one another.

The invention claimed is:

1. An apparatus for removing an object from within a bag comprising:

a surface with an aperture for receiving the object;

cutting means for cutting the bag;

positioning means for positioning the object;

displacing means for displacing the object; and a controller for controlling the cutting, the positioning, and the displacing means, wherein the surface and/or the object are arranged to be moved relative to one another;

wherein the cutting means is arranged to cut the bag;

wherein the positioning means is arranged to position the object in a first predetermined position relative to the aperture; and wherein the displacing means is arranged to move the object relative to the surface by displacing the object through the aperture; and wherein the aperture is configured such that, as the object passes through the aperture, the surface engages and separates the cut bag from the object.

2. An apparatus according to claim 1, wherein, before the positioning means is arranged to position the object in the first predetermined position, the positioning means is arranged to position the object in a second predetermined position relative to the cutting means such that the bag cut is before the object is moved into the first predetermined position.

3. An apparatus according to claim 2, wherein, in the second predetermined position, the bag intersects a cutting region of the cutting means; and wherein, in the first predetermined position, an end of the object proximate to an edge of the bag that has been cut faces the aperture.

4. An apparatus according to claim 1, wherein the displacing means comprises a moveable rod and is arranged to displace the object through the aperture via the moveable rod.

5. An apparatus according to claim 1, wherein the positioning means comprises a gripping means that is arranged to releasably grasp the object.

6. An apparatus according to claim 5, wherein the gripping means partially releases the object as it is displaced through the aperture.

7. An apparatus according to claim 1, further comprising an input conveyor that is arranged to receive and convey the object to the positioning means for positioning.

8. An apparatus according to claim 7, further comprising a position detection means that is arranged to determine positional data of the object as the object is conveyed to the positioning means, wherein the positioning means is arranged to facilitate positioning of the object using the positional data.

9. An apparatus according to claim 7, further comprising a leak detection means that is arranged to determine whether fluid has leaked into the bag.

10. An apparatus according to claim 9, wherein the positioning means is arranged to discard the object if the leak detection means determines that fluid has leaked into the bag.

11. An apparatus according to claim 8, wherein the position detection means and/or a leak detection means are implemented using a machine vision system.

12. An apparatus according to claim 1, wherein the positioning means is arranged to discard the separated bag.

13. An apparatus according to claim 12, wherein the displacing mechanism comprises a guard that is arranged to discard the separated bag from the displacing mechanism if the positioning arm fails to discard the separated bag.

14. An apparatus according to claim 1, wherein the bag is arranged to be cut a predetermined distance from the end of the object.

15. An apparatus according to claim 14, wherein the bag is arranged to be cut the predetermined distance by arranging the cutting means to cut the bag the predetermined distance from the end of the object and/or by arranging the positioning means to position the end of the object the predetermined distance from the cutting means.

16. An apparatus according to claim 1, wherein the surface is a planar structure.

17. An apparatus according to claim 1, further comprising an output conveyor, wherein the object is arranged to be received by the output conveyor after it passes through the aperture.

18. A method of removing an object from within a bag comprising the steps of:

positioning the object in a first predetermined position relative to an aperture in a surface;

cutting the bag; and moving the surface and/or the object relative to one another, wherein the aperture is configured such that, as the object passes through the aperture, the surface engages and separates the cut bag from the object, wherein the object is partially displaced through the aperture before being fully displaced through the aperture, and the bag is cut when the object is partially displaced through the aperture.

* * * * *